US008915174B1

(12) United States Patent
Heizer et al.

(10) Patent No.: US 8,915,174 B1
(45) Date of Patent: Dec. 23, 2014

(54) PROGESSIVELY PORTED GUN BARREL

(75) Inventors: Charles K. Heizer, St. Louis, MO (US); Thomas C. Heizer, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

(21) Appl. No.: 13/616,462

(22) Filed: Sep. 14, 2012

Related U.S. Application Data

(60) Provisional application No. 61/535,302, filed on Sep. 15, 2011.

(51) Int. Cl.
*F41A 21/36* (2006.01)
*F41A 21/06* (2006.01)

(52) U.S. Cl.
USPC ..... 89/14.3

(58) Field of Classification Search
USPC ..... 42/76.01, 76.1, 78; 89/14.05, 14.2, 89/14.3, 14.7, 1.41; 124/81
See application file for complete search history.

(56) References Cited

U.S. PATENT DOCUMENTS

| | | | | | |
|---|---|---|---|---|---|
| 1,605,393 | A | * | 11/1926 | Cutts, Jr. | 89/14.3 |
| 3,808,943 | A | | 5/1974 | Kelly | |
| 5,123,328 | A | * | 6/1992 | Schuemann | 89/14.3 |
| 5,243,895 | A | * | 9/1993 | Dickman et al. | 89/14.3 |
| 5,279,200 | A | * | 1/1994 | Rose | 89/14.3 |
| 5,587,549 | A | | 12/1996 | Clouse | |
| 6,269,727 | B1 | | 8/2001 | Nigge | |
| 7,886,650 | B1 | | 2/2011 | Rosenthal | |

* cited by examiner

*Primary Examiner* — Daniel J Troy
*Assistant Examiner* — John D Cooper
(74) *Attorney, Agent, or Firm* — CreatiVenture Law, LLC; Dennis J M Donahue, III

(57) ABSTRACT

The present invention is an improved barrel for a gun, wherein the gun barrel has an axis and a front face defined by a plane extending perpendicular to the axis. A plurality of ports is formed in the gun barrel. A first set of ports has a first spacing and a second set of ports is spaced apart from the first set of ports by a spacing distance greater than the first spacing.

20 Claims, 3 Drawing Sheets

PROGESSIVELY PORTED GUN BARREL

CROSS-REFERENCE TO RELATED APPLICATIONS

This application claims priority from U.S. Provisional Patent Application No. 61/535,302 filed Sep. 15, 2011 and having the title "PROGRESSIVELY PORTED GUN BARREL", which is herein incorporated in its entirety.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to gun barrels, and more particularly to a porting system for the discharge gases when firing a gun.

2. Related Art

Known firearms generally experience recoil and muzzle climb due to discharge gases when the firearm is fired. Recoil is created by a forward momentum of the bullet and results in a rearward acting force upon the firearm and the shooter. Additionally, muzzle climb creates an upward movement of the barrel when firing the firearm. Recoil and muzzle climb typically increase with the size of the bullet or projectile. Moreover, the weight of the firearm may also increase recoil and muzzle climb. Recoil and muzzle climb may cause shooters to flinch or hesitate when firing the firearm, thereby resulting in lost control of the firearm. Additionally, muzzle climb and recoil may lead to fatigue in the shooter and may inhibit the shooter's ability to fire the firearm long term. Recoil and muzzle climb further cause the firearm to move out of alignment with the target with each shot fired. As such, recoil and muzzle climb greatly decrease the shooters accuracy.

Several known firearms use ports or conduits formed in the barrel of the firearm to direct gas flow from the firearm so that recoil and muzzle climb are reduced. In particular, the porting of the barrel enables the venting of the gases in a generally upward direction during the firing process. The venting of the gases opposes the forces that generally cause muzzle climb and/or recoil. However, known porting systems generally include equally spaced ports. Because the gases in the gun barrel are not equally distributed, the equally spaced ports are typically ineffective in controlling the velocity of the gases escaping the barrel. Additionally, known porting systems include slotted or trapezoidal shaped ports. Unfortunately, these ports may not be effective in reducing the velocities of the gases escaping the barrel. As such, these ports may be satisfactory for a long barrel gun, particularly a shotgun, but such ports may cause splitting of the barrel and negatively impact the integrity of the barrel when used with firearms having short barrels.

A need remains for firearm barrel ports that significantly reduce the velocities of the gases exiting the barrel, and further reduce the risk of stress fractures created by sharp corners in the barrel, so that the porting system would be effective for any type of barrel, long or short.

SUMMARY OF THE INVENTION

In one embodiment, an improved barrel for a gun is provided, wherein the gun barrel has an axis and a front face defined by a plane extending perpendicular to the axis. A plurality of ports is formed in the gun barrel. A first set of ports has a first spacing and a second set of ports is spaced apart from the first set of ports by a spacing distance greater than the first spacing.

In another embodiment, an improved barrel for a gun is provided, wherein the barrel has an axis and a front face defined by a plane extending perpendicular to the axis. A plurality of ports is formed in the gun barrel and taper outward from an inner surface to an outer surface of the gun barrel. A first set of ports has a first spacing and a second set of ports is spaced apart from the first set of ports by a spacing distance greater than the first spacing.

In another embodiment, an improved barrel for a gun is provided, wherein the gun includes an upper gun barrel and a lower gun barrel. Each gun barrel has an axis and a front face defined by a plane extending perpendicular to the axis. A plurality of ports is formed in each gun barrel. The plurality of ports formed in the lower gun barrel being are rearward by an angle that is greater than an angle by which the plurality of ports formed in the upper gun barrel are angled rearward. Each barrel includes a first set of ports having a first spacing and a second set of ports is spaced apart from the first set of ports by a spacing distance greater than the first spacing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings.

DETAILED DESCRIPTION OF THE PREFERRED EMBODIMENTS

Figure 1:
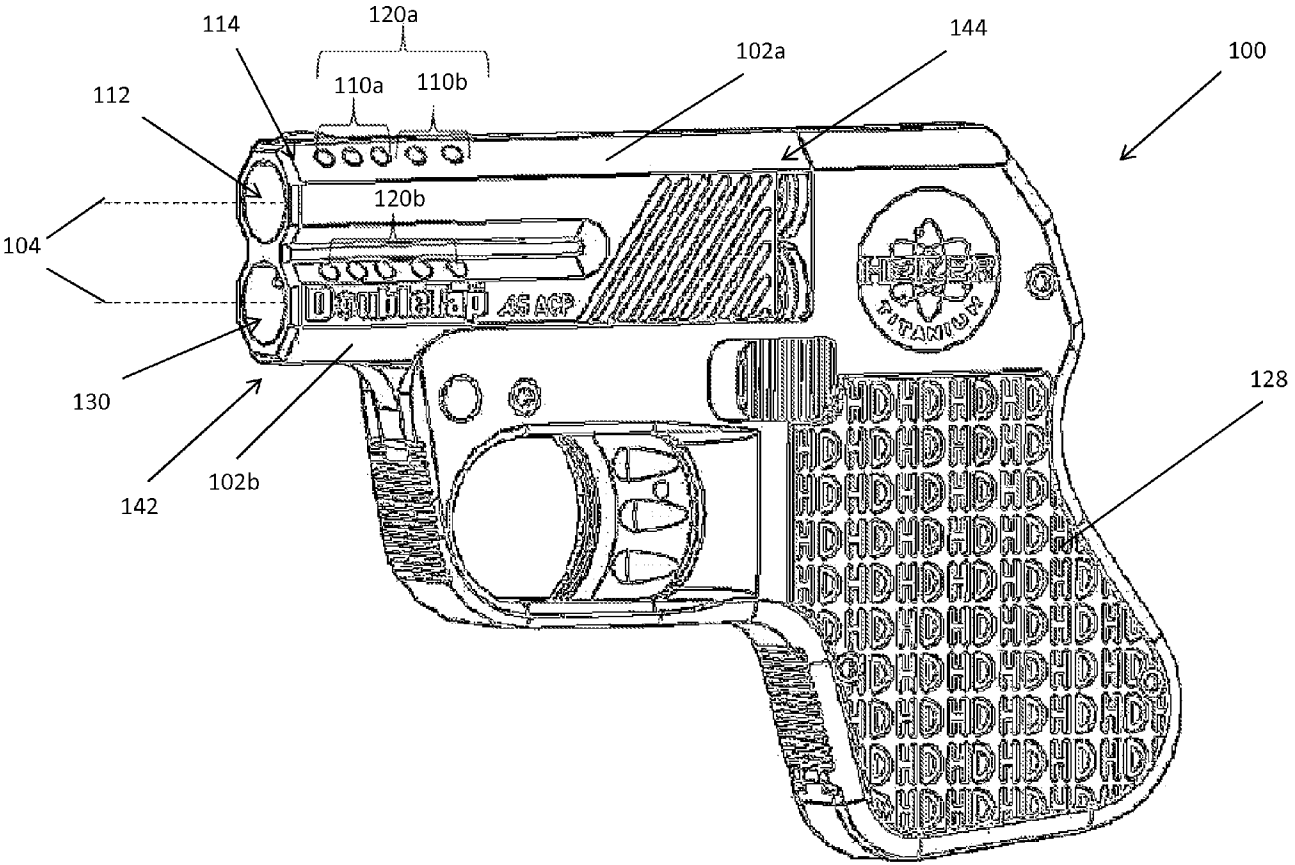
FIG. 1 is a perspective side view of a gun formed in accordance with an embodiment.

The following description of the preferred embodiment(s) is merely exemplary in nature and is in no way intended to limit the invention, its application, or uses.

The present invention is an improved barrel 102 for a gun 100, wherein the gun barrel 102 has an axis 104 and a front face 106 defined by a plane 108 extending perpendicular to the axis 104. A plurality of ports 110 is formed in the gun barrel 102, wherein a first set of ports 110*a* has a first spacing and a second set of ports 110*b* is spaced apart from the first set of ports 110*a* by a spacing distance greater than the first spacing. The first set of ports 110*a* are spaced by a first distance that is less than a second distance between the second set of ports 110*b*. In particular, the first set of ports 110*a* are spaced by a first distance that is less than a diameter of the ports 110, and the second set of ports 110*b* are spaced by a second distance that is approximately equal to the diameter of the ports 110. The spacing distance between the first set of ports 110*a* and the second set of ports 110*b* is approximately equal to the second distance between the ports 110 in the second set of ports 110*b*. The first set of ports 110*a* is positioned proximate to the front face 106 and the second set of ports 110*b* is positioned distally from the front face 106. In the illustrated embodiment, the first set of ports 110*a* includes three ports and the second set of ports 110*b* includes two ports. Each port 110 extends between an inner surface 112 and an outer surface 114 of the gun barrel 102. A radius 116 of each port 110 at the inner surface 112 is less than a radius 118 of the port 110 at the outer surface 114. In one embodiment, the plurality of ports 110 taper outward at an angle of approximately 8° from the inner surface 112 to the outer surface 114 of the gun barrel 102. The ports 110 are angled rearward with respect to the front face 106. For example, the ports 110 may be angled rearward by an angle that is between approximately 15° to 25° relative to the front face 106 of the barrel 102. The first set of ports 110*a* are angled rearward by an angle that is less than an angle by which the second set of ports 110*b* are angled rearward. Further, the ports 110 are angled upward from a horizontal plane 122 extending through the axis 104 of the gun barrel 102.

In the illustrated embodiment, the gun includes an upper gun barrel 102*a* and a lower gun barrel 102*b*. The ports 110 are arranged in rows 120*a* on the upper gun barrel 102*a* and rows 120*b* on the lower gun barrel 102*b*. The row of ports 120*b* formed in the lower gun barrel 102*b* are angled rearward by an angle that is greater than an angle by which the row of ports 120*a* formed in the upper gun barrel 102*a* are angled rearward. Each gun barrel 102 has a top portion 124 and a bottom portion 126 divided by the horizontal plane 122 extending through the axis 104 of the barrel 102. Each row of ports 120 is formed in the top portion 124 of the respective gun barrel 102.

The various orientations used herein and described with respect to the gun 100 and the gun barrel 102 are described with respect to the gun 100 being held with the gun handle 128 in a vertical orientation. The gun 100 of the present invention includes two barrels 102*a* and 102*b*; however, the gas venting ports 110 described herein may be used with a single barrel gun as well. Additionally, the gas venting ports 110 may be used with a short barrel gun, for example a pistol as shown in FIGS. 1-4, or a long barrel gun, for example a rifle or shotgun. In the illustrated embodiment, the barrels 102 of the gun 100 are positioned in a stacked configuration with the upper barrel 102*a* positioned above the lower barrel 102*b*.

Each barrel 102 has a cylindrical inner surface 112 forming a chamber 130 for the bullet to project form. An outer surface 114 of each barrel 102 is formed in an octagonal configuration having an upper segment 132 and a lower segment 134 extending horizontally and side segments 136 extending vertically. The upper segment 132 is joined to the side segments 136 with upper angled segments 138, and the lower segment 134 is joined to the side segments 136 with lower angled segments 140. In the illustrated embodiment, the lower segment 134*a* of the upper barrel 102*a* is formed integrally with the upper segment 132*b* of the lower barrel 102*b*. The axis 104 of each barrel 102 extends from a front 142 of the barrel 102 to a back 144 of the barrel 102. The horizontal plane 122 extends through the axis 104 and divides the barrel 102 into the top portion 124 and the bottom portion 126. Additionally, the plane 108 extending perpendicular to the axes 104 of the barrels 102 defines the front face 106 of each barrel 102.

As shown in FIG. 1, according to the present invention, the progressively ported barrel 102 of the gun 100 has a series of specifically designed gas venting ports 110 in the firearm barrel 102 to reduce recoil and muzzle climb by diverting pressurized gas in a specific direction and/or angle. The ports 110 are progressively arranged along the gun barrel 102 so that a spacing between adjacent ports 110 may vary along the gun barrel 102. In particular, at least some of the ports 110 are unequally spaced along the gun barrel 102. Each of the ports 110 may be unequally spaced or the ports 110 may be equally spaced within a set. For example, a set of ports 110*a* positioned proximate to the front face 106 may have a first spacing, and a second set of ports 110*b* spaced from the first set of ports 110*a* and positioned distally from the front face 106 may have a second spacing. In an exemplary embodiment, the first set of ports 110*a* has a spacing that is less than the spacing of the second set of ports 110*b*. For example, the first set of ports 110*a* may include three ports 110 spaced by a distance that is less than a diameter of the ports 110, and the second set of ports 110*b* may include two ports 110 spaced by a distance that is approximately equal to or greater than the diameter of the ports 110.

Figure 2:
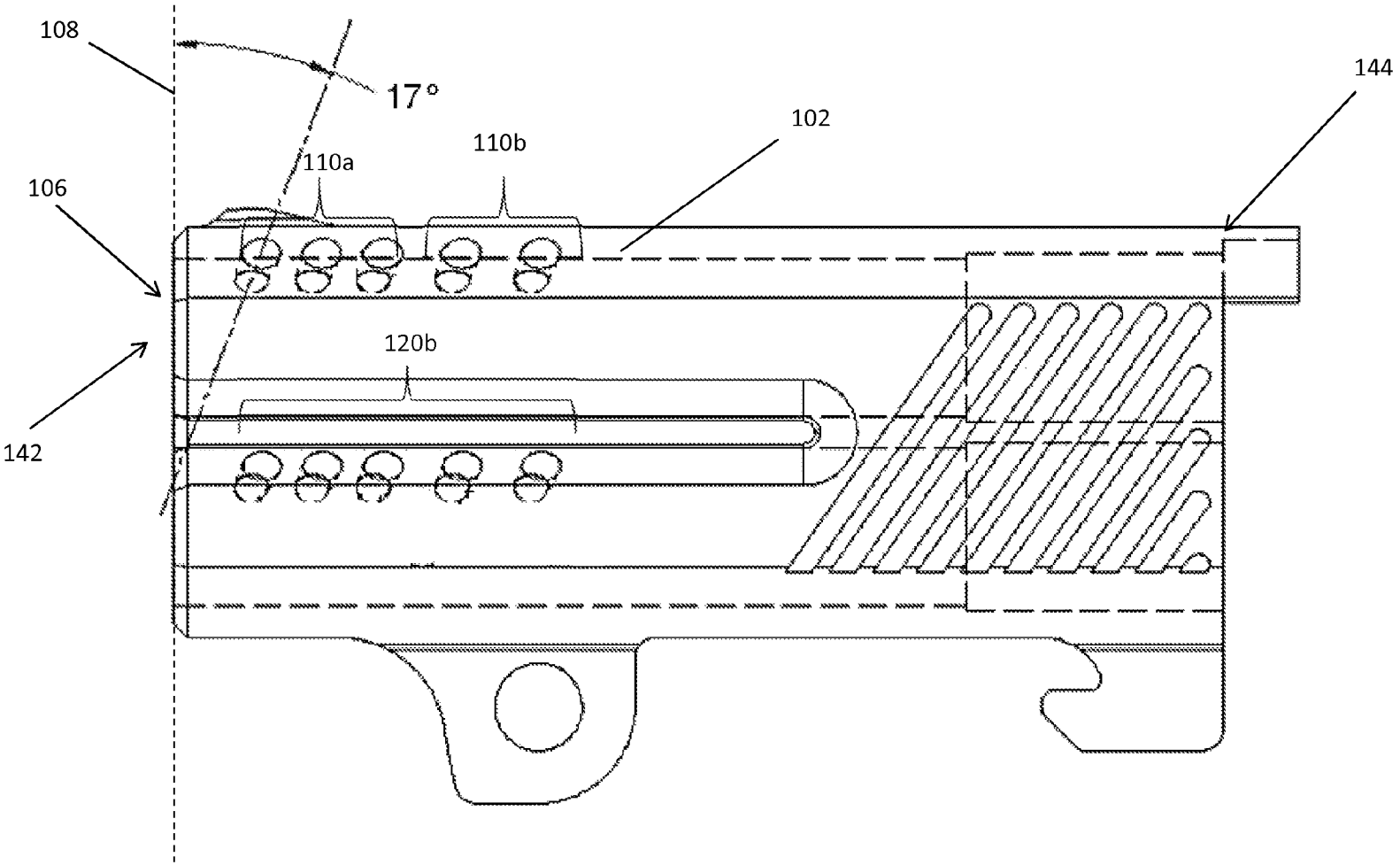
FIG. 2 is a side view of a gun barrel formed in accordance with an embodiment.
Figure 4:
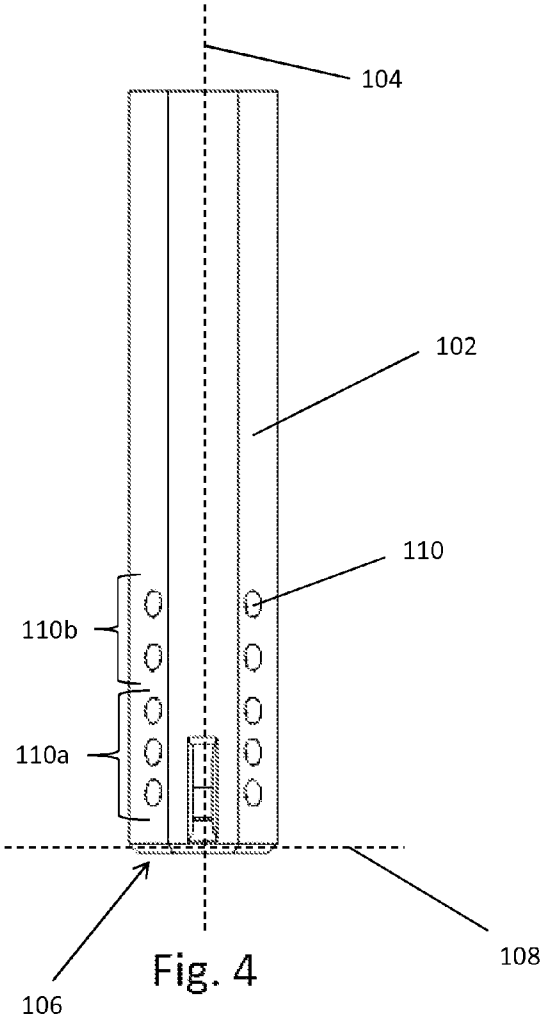
FIG. 4 is a top view of a gun barrel formed in accordance with an embodiment.
Figure 3:
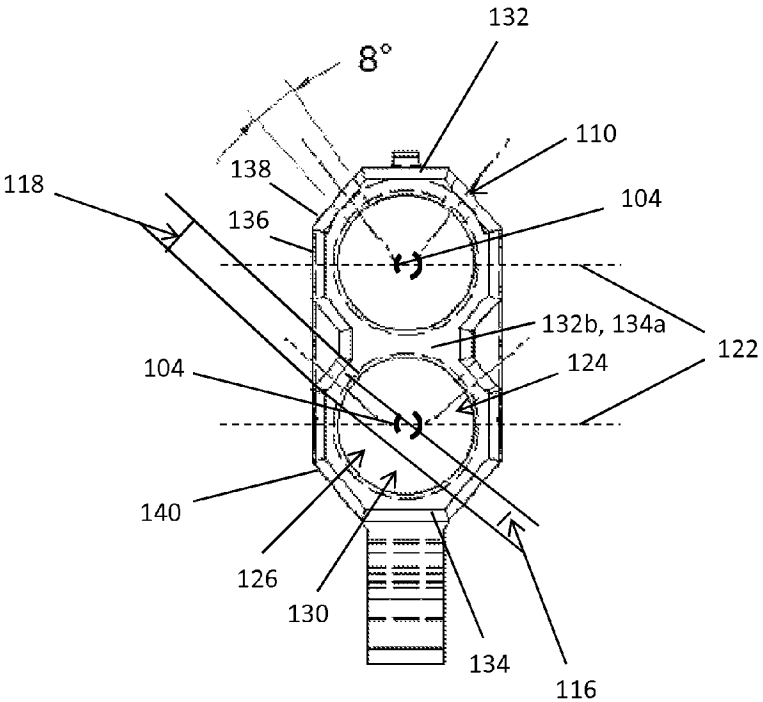
FIG. 3 is a front view of a gun barrel formed in accordance with an embodiment.

As shown in FIG. 2, the ports 110 are angled rearward toward the back 144 of the barrel 102 with respect to the front face 106 of the barrel 102. The ports 110 are formed in the top portion 124 of the barrel 102. In particular, the ports 110 are formed in each upper angled segment 138 of the barrel 102. The ports 110 extend from the inner surface 112 of the barrel 102 to the outer surface 114 of the barrel 102 to form a hole in the barrel 102. When the gun 100 is fired, the gas forced rearward out of the ports 110 creates a forward force on the gun barrel 102 which helps reduce the recoil. As shown in FIG. 3, the ports 110 are also angled upwards and outwards from the barrel's axis 104. When the gun 100 is fired, the gas forced upwards out of the ports 110 creates a downward force on the gun barrel 102 which helps reduce the muzzle climb. The upward and outward angle of the ports 110 can be varied.

In the preferred embodiment that is shown, the rearward facing angle of the ports 110 is approximately 17° relative to the front face 106 formed by the plane 108 that is perpendicular to the axis 104 of the barrel 102. A range of angles would work for the rearward facing angle, such as 15°-25°. However, the steepness of the rearward facing angle should be limited to avoid blowback of the gases into the face of the shooter. The ports 110 are arranged in two rows of ports 120 angled toward the top of the barrel 102 with multiple ports 110 in each row 120. Each row 120 is formed in an upper angled segment 138 of the barrel 102. Each port 110 is formed at the same angle as the corresponding port 110 in the row of ports 120 formed in the opposite upper angled segment 138. It is possible to steepen the angle of the ports 110 as they progress to the front 142 of the barrel 102 from the back 144 or aft of the barrel 102. Accordingly, the aft-most port 110 may have a rearward facing angle of 25° whereas the front-most port 110 may have a steeper angle.

Each one of the ports 110 is tapered to give the port 110 a conical shape. The ports 110 taper from the inner surface 112 of the barrel 102 to the outer surface 114 of the barrel 102. Each port 110 has a radius 116 at the inner surface 112 of the barrel 102 that is less than a radius 118 of the port 110 at the outer surface 114 of the barrel 102. The ports 110 may taper from the inner surface 112 to the outer surface 114 at an angle of approximately 8°. The conical shape of the ports 110 helps reduce the impact of the recoil without any significant impact on the velocity of the projectile exiting the barrel 102.

In the case of a double barrel gun 100 with an upper/lower configuration, such as shown in FIGS. 1-4, the row of ports 120*b* on the lower barrel 102*b* may be angled more outwards than the row of ports 120*a* on the upper barrel 102*a*. In particular, the each port 110 in the row of ports 120*b* may have an angle that is greater than the corresponding port 110 in the row of ports 120*a*. Also, the upper barrel 102*a* and the lower barrel 102*b* may have a different number of ports 110. For example, the upper barrel 102*a* may have more ports 110 in the row of ports 120*a* than the lower barrel 102*b* has ports 110 in the row of ports 120*b*. Alternatively, the lower barrel 102*b* may have more ports 110 in the row of ports 120*b* than the upper barrel 102*a* has ports 110 in the row of ports 120*a*.

As compared with other barrel port systems, the present invention differs in that the ports are progressively spaced along the barrel and each port has circular cone shape, thereby reducing the velocities of the gases exiting the barrel. The progressive spacing of the ports results in an uneven porting of the gases from the barrel. Also, the circular shape of the ports reduces the risk of stress fractures created by sharp corners. Designs with a trapezoidal shape may be satisfactory for a long barrel gun, particularly a shotgun, but this shape could cause splitting of the barrel and negatively impact the integrity of the barrel. The present invention would work for any type of barrel, long or short.

The present invention reduces the upward movement of the gun barrel caused by muzzle climb and/or recoil. As such, flinching or hesitation by the shooter is decreased when firing the firearm, so that the shooter has better control of the firearm. The present invention also reduces fatigue in the shooter and increases the shooter's ability to fire the gun long term. Moreover, the ports described herein reduce movement of the gun so that alignment with the target is maintained with each shot fired, thereby increasing the shooters accuracy.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An improved barrel for a gun, the improvement comprising:

a gun barrel having a top portion, a bottom portion, a horizontal plane, an axis and a front face, wherein the horizontal plane extends through the axis of the gun barrel between the top portion and the bottom portion, and wherein the front face is defined by a plane extending perpendicular to the axis; and a plurality of ports formed in the top portion of the gun barrel in two rows on opposite sides of the axis, wherein a first set of ports in each of the rows has a first spacing and a second set of ports in each of the rows is spaced apart from the first set of ports by a spacing distance greater than the first spacing, wherein the first set of ports are spaced by a first distance that is less than a second distance between the second set of ports, and wherein the ports are angled away from the horizontal plane and the bottom portion of the gun barrel.

2. The invention of claim 1, wherein the ports have a tapered conical shape with an inner radius less than an outer radius.

3. The invention of claim 2, wherein the first set of ports is positioned proximate to the front face and the second set of ports is positioned distally from the front face.

4. The invention of claim 2, wherein the first distance is less than a diameter of the ports and the second distance is approximately equal to the diameter of the ports, and wherein the spacing distance is approximately equal to the second distance.

5. The invention of claim 1, wherein the ports are angled rearward by an angle that is less than 20% relative to the front face of the barrel.

6. The invention of claim 5, wherein the first set of ports are angled rearward by an angle that is less than an angle by which the second set of ports are angled rearward.

7. The invention of claim 5 further comprising an upper gun barrel and a lower gun barrel, the plurality of ports formed in the lower gun barrel being angled rearward by an angle that is greater than an angle by which the plurality of ports formed in the upper gun barrel are angled rearward.

8. The invention of claim 7, wherein the ports in the lower gun barrel are angled outwardly more than the ports in the upper gun barrel.

9. An improved barrel for a gun, the improvement comprising:

a gun barrel having an axis and a front face defined by a plane extending perpendicular to the axis; and a plurality of ports formed in the gun barrel and tapering outward from an inner surface to an outer surface of the gun barrel, wherein a first set of ports has a first spacing and a second set of ports is spaced apart from the first set of ports by a spacing distance greater than the first spacing, and wherein the first set of ports are spaced by a first distance that is less than a second distance between the second set of ports.

10. The invention of claim 9, wherein the tapering of the ports form a tapered conical shape in each of the ports with an inner radius that is less than an outer radius.

11. The invention of claim 10, wherein the gun barrel further comprises a top portion, a bottom portion, a horizontal plane, wherein the horizontal plane extends through the axis of the gun barrel between the top portion and the bottom portion, wherein the first set of ports is positioned proximate to the front face in two rows on opposite sides of the axis and the second set of ports is positioned distally from the front face and are also in the two rows on opposite sides of the axis, and wherein the ports are angled away from the horizontal plane and the bottom portion of the gun barrel.

12. The invention of claim 10, wherein the first distance is less than a diameter of the ports and the second distance is approximately equal to the diameter of the ports, and wherein the spacing distance is approximately equal to the second distance.

13. The invention of claim 9, wherein the ports are angled rearward by an angle that is between 15° to 25° relative to the front face of the barrel.

14. The invention of claim 13, wherein the first set of ports are angled rearward by an angle that is less than an angle by which the second set of ports are angled rearward.

15. The invention of claim 13 further comprising an upper gun barrel and a lower gun barrel, the plurality of ports formed in the lower gun barrel being angled rearward by an angle that is greater than an angle by which the plurality of ports formed in the upper gun barrel are angled rearward.

16. An improved barrel for a gun, the improvement comprising:

an upper gun barrel and a lower gun barrel, each gun barrel having an axis and a front face defined by a plane extending perpendicular to the axis; and a plurality of ports formed in each gun barrel, the plurality of ports formed in the lower gun barrel being angled rearward by an angle that is greater than an angle by which the plurality of ports formed in the upper gun barrel are angled rearward, wherein each barrel includes a first set of ports having a first spacing and a second set of ports is spaced apart from the first set of ports by a spacing distance greater than the first spacing.

17. The invention of claim 16, wherein the first set of ports are spaced by a first distance that is less than a second distance between the second set of ports.

18. The invention of claim 17, wherein the first set of ports is positioned proximate to the front face and the second set of ports is positioned distally from the front face.

19. The invention of claim 17, wherein the first distance is less than a diameter of the ports and the second distance is approximately equal to the diameter of the ports, and wherein the spacing distance is approximately equal to the second distance.

20. The invention of claim 16, wherein the first set of ports are angled rearward by an angle that is less than an angle by which the second set of ports are angled rearward.

* * * * *